United States Patent [19]

Watanabe et al.

[11] Patent Number: 5,077,585

[45] Date of Patent: Dec. 31, 1991

[54] COVERED SCANNING APPARATUS WITH AUTOMATIC SHEET FEEDING MECHANISM

[75] Inventors: Junji Watanabe, Yokohama; Yuji Ishikawa, Machida, both of Japan

[73] Assignee: Kabushiki Kaisha Toshiba, Kawasaki, Japan

[21] Appl. No.: 372,567

[22] Filed: Jun. 28, 1989

[30] Foreign Application Priority Data

Jun. 29, 1988 [JP] Japan ..... 63-159457

[51] Int. Cl.[5] ..... G03G 21/00

[52] U.S. Cl. ..... 355/321; 355/231; 355/318

[58] Field of Search ..... 355/321, 230, 231, 75, 355/318, 319, 320; 271/902, 186, 291

[56] References Cited

U.S. PATENT DOCUMENTS

| | | | |
|---|---|---|---|
| 3,804,514 | 4/1974 | Jasinski | 355/75 |
| 3,888,581 | 6/1975 | Caldwell | 355/75 X |
| 4,077,714 | 3/1978 | Komori et al. | 355/230 X |
| 4,218,128 | 8/1980 | Satomi et al. | 355/321 X |
| 4,234,180 | 11/1980 | Looney | 271/3.1 |
| 4,285,512 | 8/1981 | Shlatz | 355/230 |
| 4,439,036 | 3/1984 | Davis et al. | 355/231 |
| 4,602,868 | 7/1986 | Tsubo | 355/77 |
| 4,610,446 | 9/1986 | Ide | 271/902 X |
| 4,632,376 | 12/1986 | Dubois | 271/902 X |
| 4,662,738 | 5/1987 | Kasuya | 355/208 |
| 4,667,951 | 5/1987 | Honjo et al. | 271/902 X |
| 4,699,365 | 10/1987 | Smith et al. | 271/902 X |
| 4,734,747 | 3/1988 | Okuda et al. | 355/206 X |
| 4,739,376 | 4/1988 | Kanekol | 355/75 |
| 4,739,983 | 4/1988 | Ide et al. | 271/233 |
| 4,849,787 | 7/1989 | Honjo et al. | 355/313 |

FOREIGN PATENT DOCUMENTS

| | | |
|---|---|---|
| 0263398 | 4/1988 | European Pat. Off. . |
| 3716768 | 11/1987 | Fed. Rep. of Germany . |

*Primary Examiner*—A. T. Grimley
*Assistant Examiner*—Nestor R. Ramirez
*Attorney, Agent, or Firm*—Foley & Lardner

[57] ABSTRACT

An original scanning apparatus comprises a housing having an original placing platen for placement of an original, an optical system for scanning an original on the original placing platen to obtain information corresponding to the original, a cover for covering the original on the original placing platen, a scale for designating the size of the original provided at one side of the original placing platen, an automatic sheet feeding mechanism provided separately from the cover for feeding the original through the scale between the original placing platen and the cover, and a sheet exhausting mechanism for feeding the scanned original from the original placing platen through the scale out of the original placing platen.

17 Claims, 15 Drawing Sheets

COVERED SCANNING APPARATUS WITH AUTOMATIC SHEET FEEDING MECHANISM

BACKGROUND OF THE INVENTION

1. Field of the Invention

The present invention relates to an original scanning apparatus for use, for example, in an image forming apparatus, such as an electronic copying machine containing an image forming means for forming an image corresponding to an original set on an original placing platen. More particularly the present invention relates to an original scanning apparatus having an automatic original feeding function for automatically conveying an original onto an original placing platen.

In a conventional image forming apparatus having an automatic original feeder, the automatic original feeder contains a wide endless conveying belt and a belt driving mechanism for rotatably feeding the conveying belt. The conveying belt and belt driving mechanism are disposed in a cover portion to be superposed on an original placing platen to transport an original from an original feeder provided at one end of the original placing platen onto the original placing platen and to exhaust the original. The original fed from the original feeder is set with a scale disposed at an opposite side to the original feeder, i.e., at the other end of the original placing platen as a reference.

Since the conventional automatic original feeder has, however, a wide conveying belt driving mechanism in the cover portion, the following problems arise.

The cost of the cover portion is high. The weight of the cover portion becomes heavy, and, as a result, the cover is rarely opened or closed. Since the wide conveying belt is rotatably fed in contact with all of the surface of the original placing platen, a large amount of power and a large power source are required. Also, noise is generated. Originals of A4 size are only about one-half the length of the original placing platen. When automatically fed, they are conveyed substantially the same distance as the length of the original placing platen. Thus, the original supplying cycle, in the case that a number of A4 originals are automatically fed, is increased and image forming efficiency is reduced.

SUMMARY OF THE INVENTION

Accordingly, objects of the present invention include providing an original scanning apparatus which can largely reduce the cost of an automatic original feeder, have a cover portion which can be easily opened or closed, consume less power and employ a smaller power source in the automatic original feeder, decrease noise, and shorten the supplying cycle of the automatic original feeder.

BRIEF DESCRIPTION OF THE DRAWINGS

FIGS. 3A and 3B are perspective views showing an original placing platen and a platen cover of an automatic original feeder, wherein FIG. 3A shows the opened state of the platen cover and FIG. 3B shows the closed state;

DETAILED DESCRIPTION OF THE PREFERRED EMBODIMENTS

An embodiment of the present invention will now be described in detail with reference to the accompanying drawings.

Figure 2:
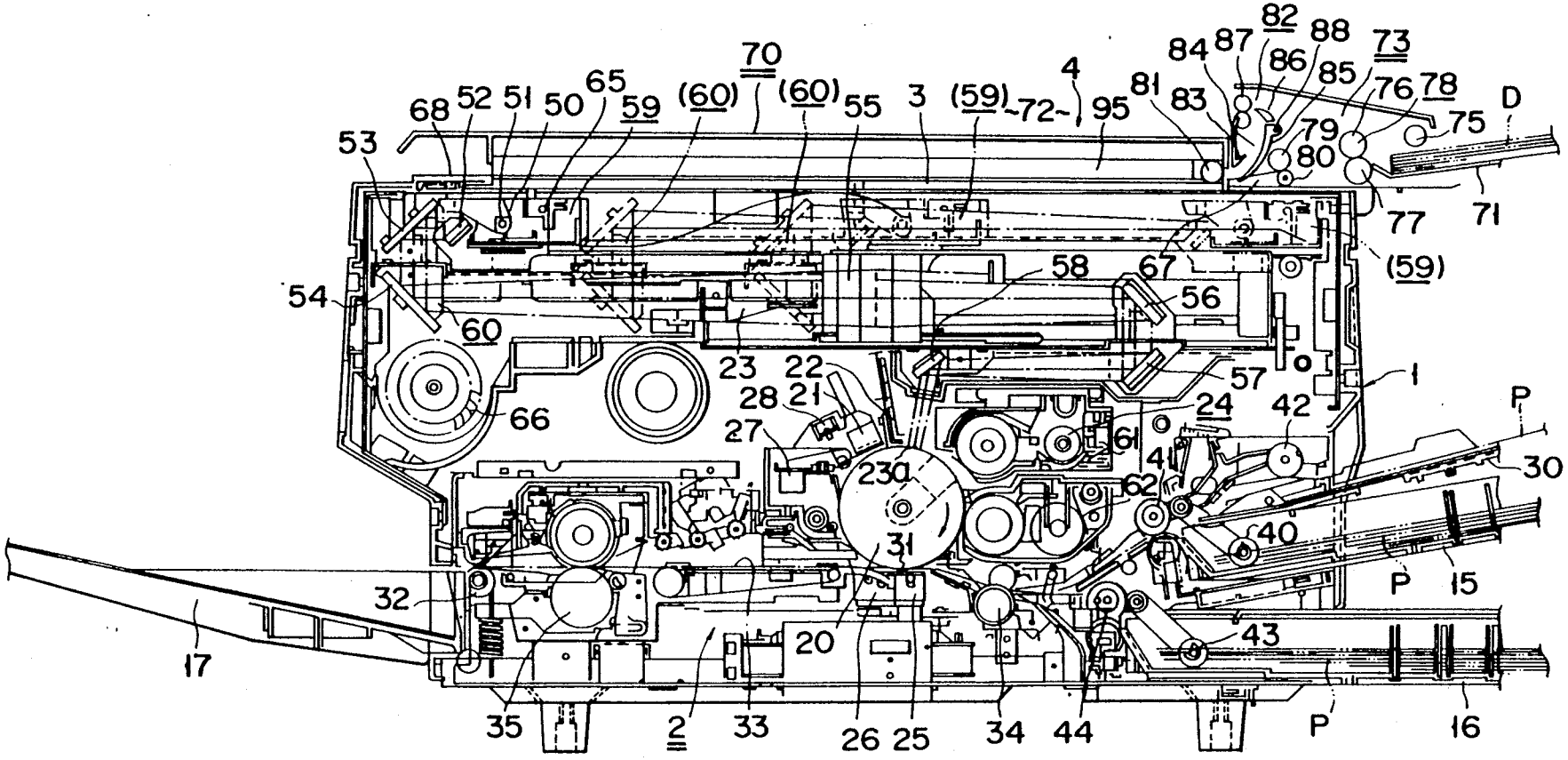
FIG. 2 is a view showing the interior of a housing of an image forming apparatus.
Figure 3A:
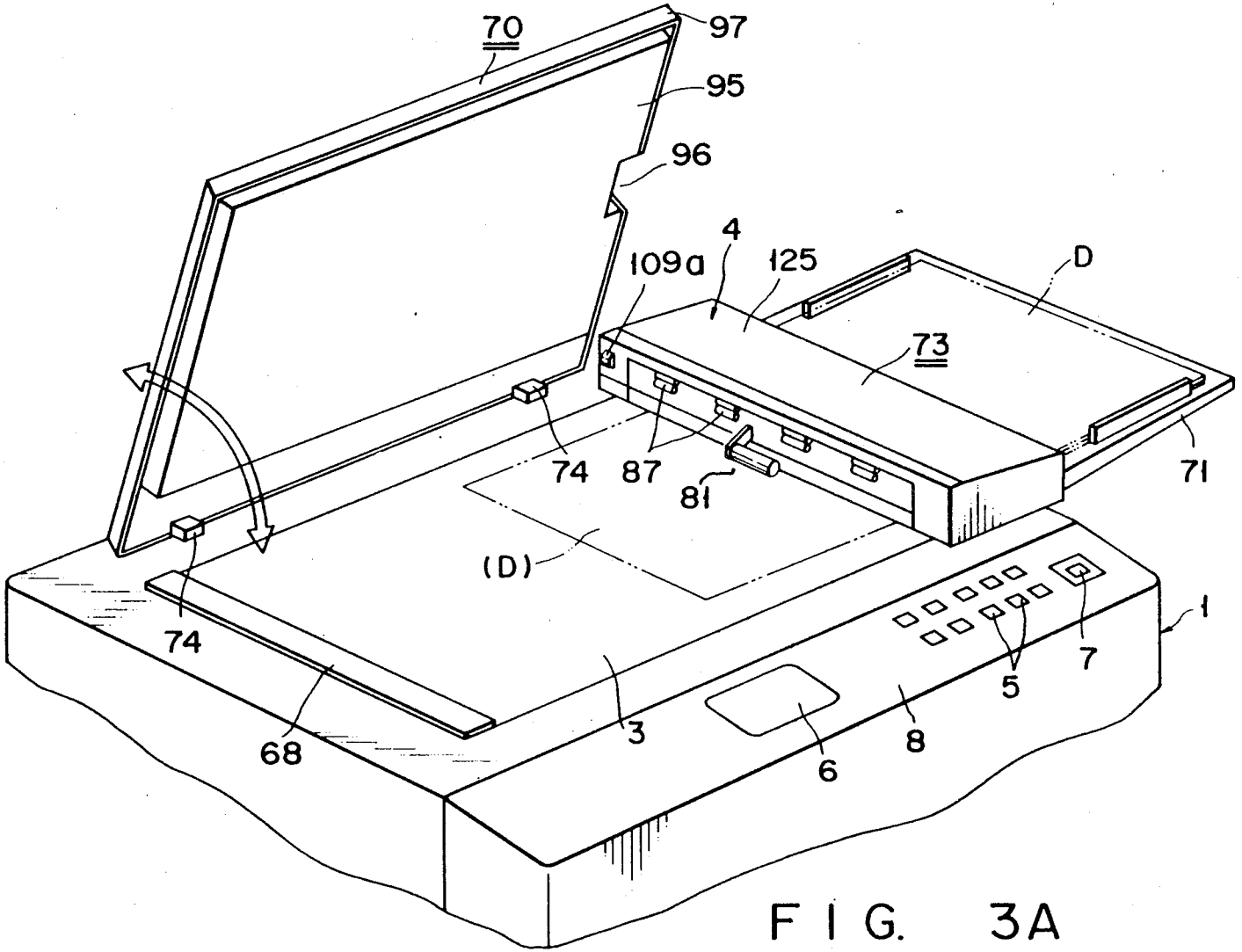
Figure 3B:
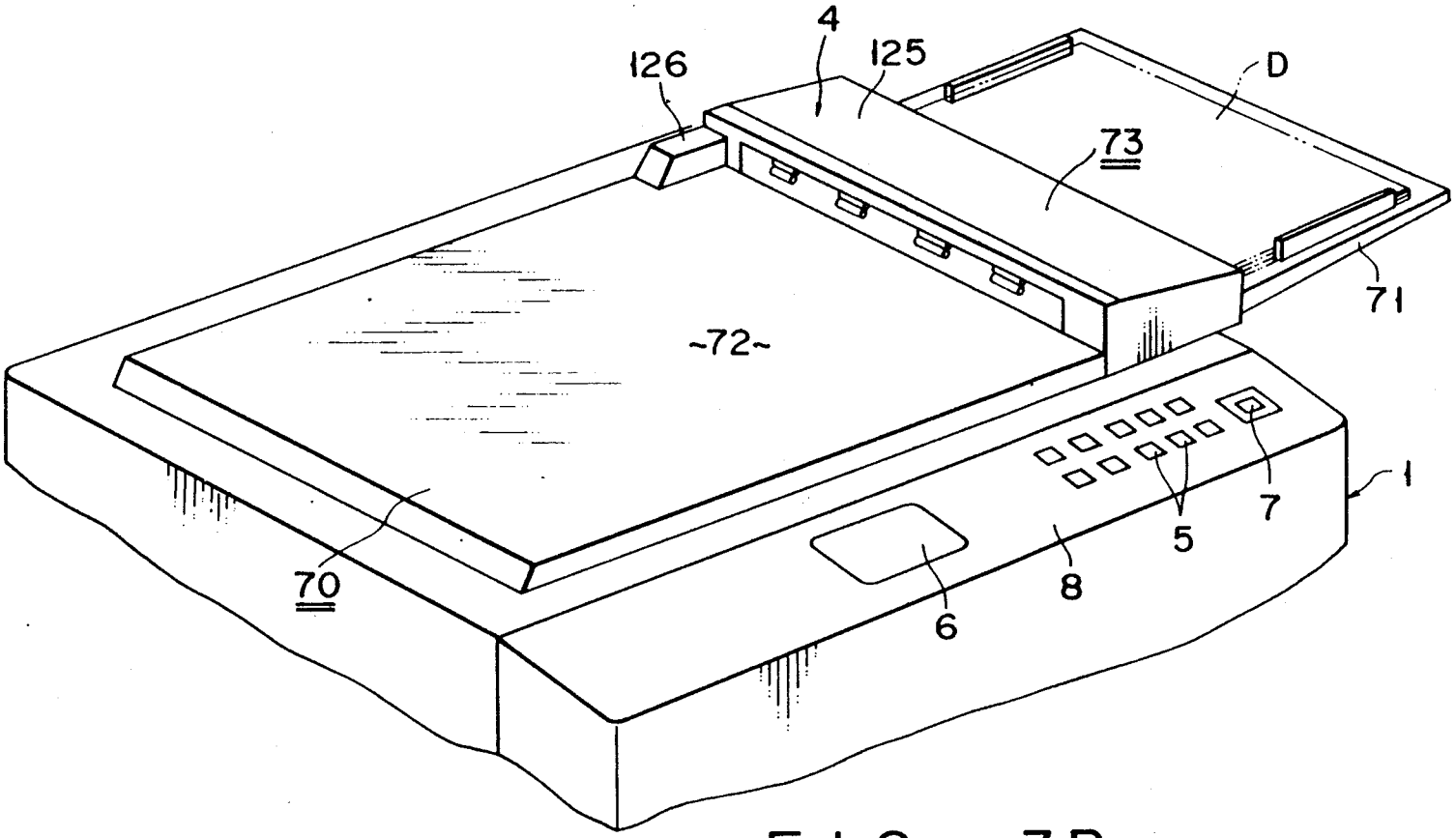

FIG. 2 shows an internal arrangement of an entire original scanning apparatus. In FIG. 2, reference numeral 1 denotes an apparatus body containing an image forming means 2 for charging, exposing, developing, transferring, cleaning, fixing and the like in housing 1*a*. On an upper surface of apparatus body 1 is provided automatic original feeder (ADF) 4 for setting original D on platen glass 3 as an original placing platen or remaining original D from platen glass 3. As is shown in FIGS. 3A and 3B, operation panel 8 on which ten keys 5, guide display 6, copy key 7 and the like are disposed is positioned on the front of the upper surface of apparatus body 1.

At the right side of apparatus body 1 are attached a first sheet supply cassette (hereinafter referred to as "upper stage cassette") 15 (FIG. 2) and a second sheet supply cassette (hereinafter referred to as "lower stage cassette") 16. Cassettes 15 and 16 hold a number of paper sheets P, such as plain sheets to be supplied to image forming means 2. At the left side of apparatus body 1 is attached tray 17 for manually fed sheets P.

Image forming means 2 comprises drum-shaped photosensitive unit 20 as an image carrier disposed at the center of apparatus body 1, electric charger 21, eraser 22, exposure portion 23*a* of exposure device 23, developing device 24, transferring device 25, separating device 26, cleaning device 27 and charge eliminator 28 sequentially disposed around photosensitive unit 20 along the rotating direction of photosensitive unit 20 (as designated by an arrow).

In apparatus body 1 is formed sheet conveying passage 33 for guiding sheet P automatically from upper stage cassette 15 or lower stage cassette 16, or sheet P manually fed through manual sheet feeding tray 30 as a cover of upper stage cassette 15 to sheet exhausting roller pair 32 provided at the left side of apparatus body 1 through image transferring portion 31 between photosensitive unit 20 and transferring device 25.

Aligning roller pair 34 is disposed at the upstream side of image transferring portion 31 of sheet conveying passage 33, and fixing device 36 is disposed at the downstream side thereof.

In the vicinity of the upper stage cassette 15 are arranged separating and conveying means 41 having pickup roller 40 attached to a rockable arm for picking up sheets P one by one, and a conveying roller and a separating roller for feeding sheet P picked up by pickup roller 40 into a first branch conveying passage for forming the upstream side of sheet conveying passage 30. Also in this area is manual feed roller 42 for feeding manually inserted sheets P into the first branch conveying passage between the conveying roller and the separating roller of separating and conveying means 41.

In the vicinity of lower stage cassette 16 are arranged pickup roller 43 attached to a rockable arm for picking up sheets P one by one, and separating and conveying means 44, and separating and conveying means 44 having a conveying roller and a separating roller for feeding sheet P picked up by pickup roller 43 into a second branch conveying passage for forming the upstream side of sheet conveying passage 33.

Exposure device 23, of the optical system moving type, radiates original D which is set on flat plate-shaped platen glass 3 disposed horizontally on the upper surface of apparatus body 1. Exposure device 23 includes exposure lamp 51 surrounded at its back by reflector 50. Reflected light from the original surface is introduced sequentially through first mirror 52, second mirror 53 and third mirror 54 to lens 55. The light passed through lens 55 is introduced sequentially through fourth mirror 56, fifth mirror 57 and sixth mirror 58 to photosensitive unit 20.

Exposure lamp 51 and first mirror 52 surrounded by reflector 50 are placed on first carriage 59. Carriage 59 is laterally reciprocatedly movable along the lower surface of platen glass 3. Second mirror 53 and third mirror 54 are placed on second carriage 60. Carriage 60 moves at half the speed of first carriage 59 in the same direction as first carriage 59. Carriages 59 and 60 are moved by driving mechanism M (such as a motor) from left to right as designated by the broken lines in FIG. 2. This movement is effected when original D is positioned at a left scale (to be described later) to scan original D on platen glass 3, thereby slit-exposing an image of original D on photosensitive unit 20.

Developing device 24 has color developing upper developing unit 61 and a black developing lower developing unit 62 to selectively develop black and other colors, such as red.

Charger 21, eraser 22, exposure device 23, developing device 24, transferring device 25, separating device 26, cleaning device 27, charge eliminator 28 and fixing device 35 are constructed as known, and detailed descriptions will be accordingly omitted.

When original D is to be copied, for example, and a certain region of original D is to be erased, a spot unit 65 on first carriage 59 designates the region, and eraser 22 can erase the charge of the portion corresponding to the region designated by spot unit 65. Cooling fan 66 is disposed at the upper position of fixing device 35 in apparatus body 1.

An original D of maximum A3 size (for an use abroad) can be set on platen glass 3 with right scale 67 or left scale 68 (to be described later) as a reference.

As is shown in FIGS. 3A and 3B, automatic original feeder (ADF) 4 generally comprises: original retainer cover (hereinafter referred to as "a platen cover") 70 to be superposed on platen cover 3; original tray 71 on which a plurality of originals D can be simultaneously set in a stack; platen sheet 95 (to be described later) for platen cove 70 for sequentially picking up originals D one by one from above an original tray 71; and original feeding mechanism 73 for feeding originals D to platen glass 3, removing originals D from between platen sheet 95 of platen cover 70 and platen glass 3 after a copying operation is completed, and holding exhausted original D in exhausted original container 72.

Figure 1:
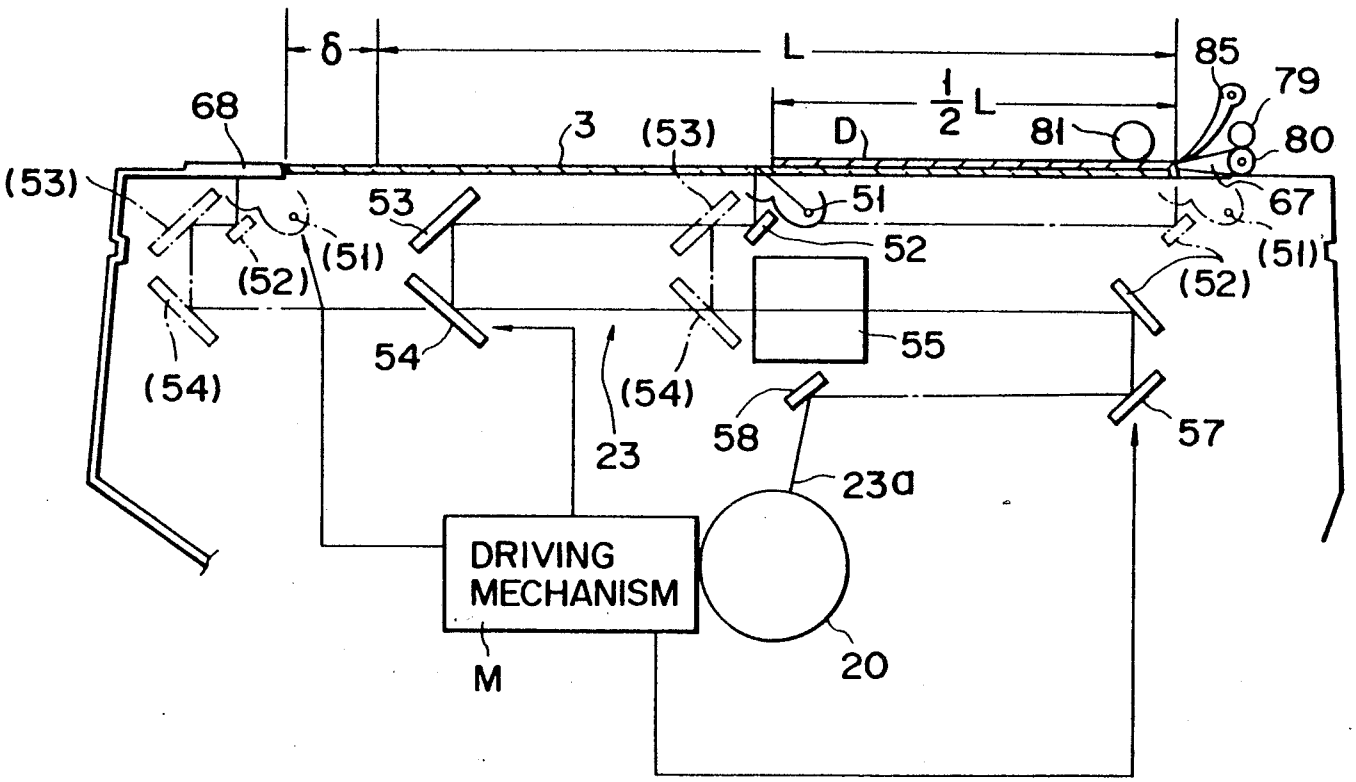
FIG. 1 is a view showing the moving state of an optical scanning mechanism when an original is set in position by an automatic original feeder.

Original feeding mechanism 73 is provided at an exposure starting position of the optical system moving type exposure device 23, i.e., next to right scale 67 (oppositely to left scale 68). Scales 67 and 68 provide a reference for setting the original in the exposure starting position, as shown in FIG. 1. Scales 67 and 68 are respectively provided at the right and left ends of platen glass 3, and extend longitudinally forward and backward of the platen glass. Each scale is composed of a long plate on the upper surface of which are described original sizes. Reference character L in FIG. 1 denotes the maximum copying size, being slightly shorter than the length $(L+\delta)$ of platen glass 3.

Platen cover 70 is attached at its rear end to the upper surface of apparatus body 1 through a pair of hinge members 74 (FIG. 3A). Platen cover 70 is rotatable with respect to the apparatus body. The platen cover 70 can assume an open state in which the upper surface of platen glass 3 is uncovered (as shown in FIG. 3A) and can assume a closed state in which it is superposed on platen glass 3 (as shown in FIG. 3B). Hinge members 74 are upwardly movable with respect to the upper surface of apparatus body 1. When thick material, such as a book, is copied, platen cover 70 is moved upwardly with respect to platen glass 3. This sets platen sheet 95 of platen cover 70 in a position parallel with platen glass 3, thereby enabling the entire book to be uniformly pressed by cover 70.

Figure 4:
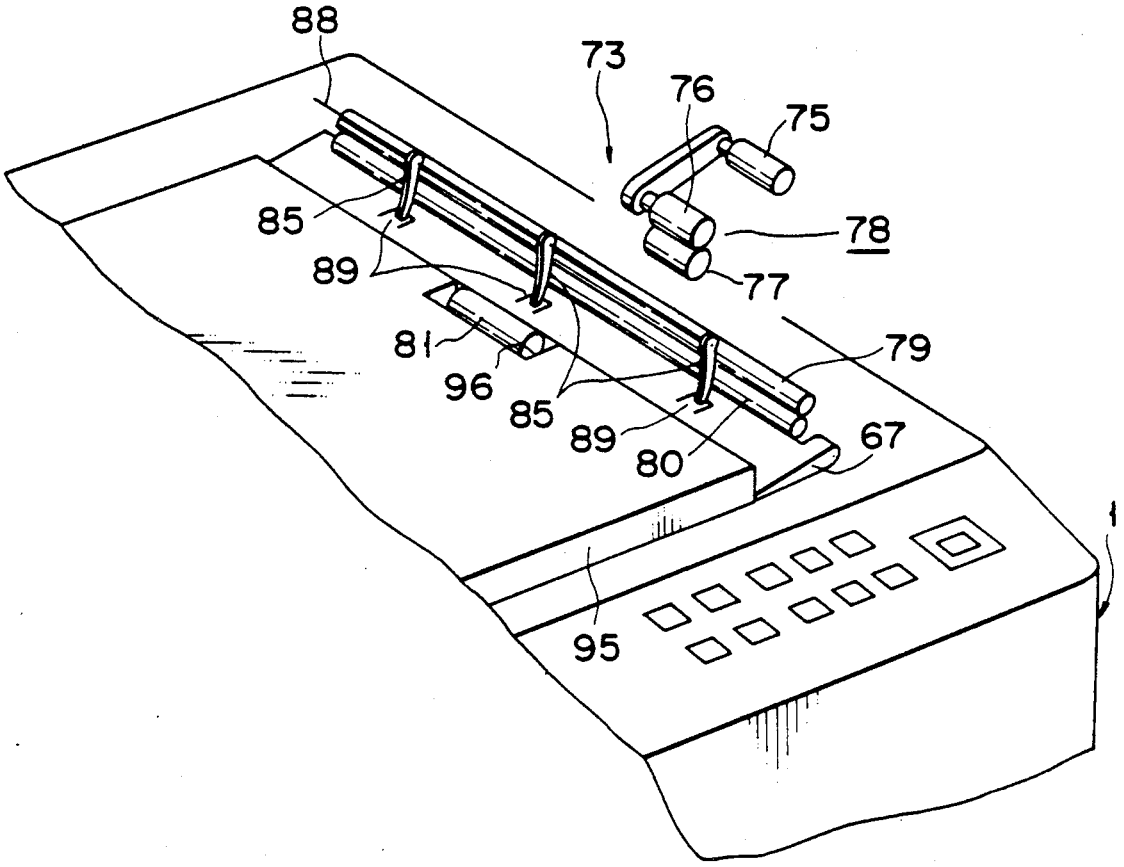
FIG. 4 is a perspective view schematically showing the arrangement of an original feeding mechanism of the automatic original feeder.

As is shown in FIGS. 2 and 4, original feeding mechanism 73 has a pickup roller 75. Roller 75 is positioned over original tray 71 and is elevationally movable upwardly or downwardly relative to originals D set on original tray 71. Feeding mechanism 73 also includes single sheet pickup means 78 comprising supplying roller 76 and separating roller 77, and registering roller pair 79. Feeding mechanism 73 rotatably drives these rollers in a predetermined direction through a driving system, not shown. Right scale 67 is rockably attached at its base to a horizontal shaft which also rotatably supports the shaft of lower roller 80. In other words, lower roller 80 and right scale 67 are coaxially mounted. As shown in FIG. 4, the center of the base of right scale 67 is cut out, and lower roller 80 is engaged within the cutout. Right scale 67 is rocked (as will be described) by a solenoid, not shown.

Feed roller 81 is provided at the left side of right scale 67 in rotatable contact with the right end of the upper surface of platen glass 3. Roller 81 is selectively rotated in a forward or reverse direction by a driving system (not shown) to feed or exhaust originals D in rotatable contact therewith. Original exhausting unit 82 is provided above right scale 67 for moving originals exhausted by feed roller 81 to exhausted original container 72. Container 72 is formed of the upper surface of platen cover 70 Original exhausting unit 82 comprises a first guide plate 83 disposed at its lower end above the end of right scale 67. Unit 82 also includes a plurality of gates 85 so arranged on the right portion of first guide plate 83 to form, with guide plate 83, an original exhausting passage 84. A second guide plate 86 is arranged above the gates, and an exhaust roller pair 87 is arranged on the end of original exhausting unit 84 (FIG. 2). Gates 85 are spaced laterally at a predetermined interval, and are rotatably attached together to a common shaft 88. The lower ends of gates 85 extend into a plurality of grooves 89 formed on the upper surface of the free end (left end) of right scale 67. These grooves are formed on the upper oblique surface of right scale 67. They have a triangular sectional shape with a horizontal lower surface and a vertical base end surface.

Figure 5:
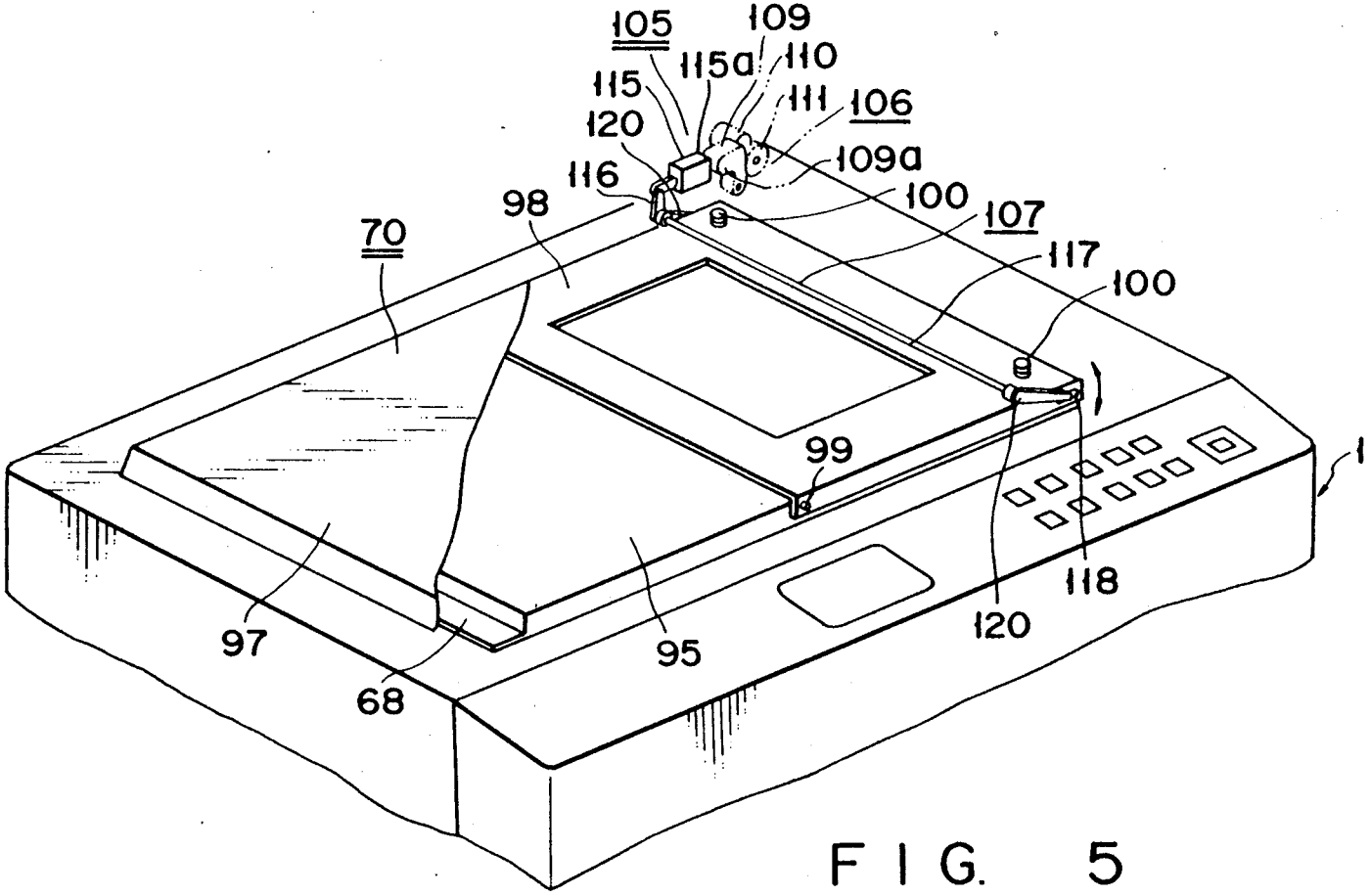
FIG. 5 is a perspective view schematically showing a platen cover and gap forming means.
Figure 6:
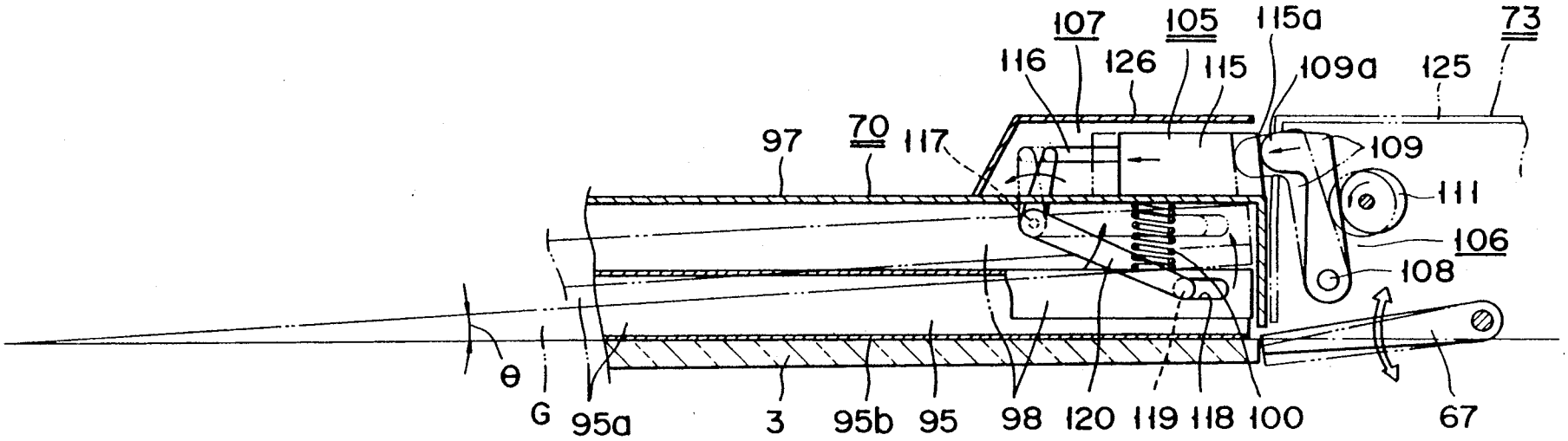
FIG. 6 is a view schematically showing gap forming means.

Platen cover 70 is constructed as is shown in FIGS. 5 and 6. Reference numeral 95 denotes a platen sheet which has a rectangular flat plate shape. Platen sheet 95 has an upper surface and a lower surface which are the same size. Sheet 95 is composed of an elastic member 95*a* made of urethane or the like, and a white sheet 95*b*. White sheet 95*b* has a low frictional coefficient and is bonded to the lower surface of elastic member 95*a*. Sheet 95 has cutout 96 (FIG. 4) for disposing feed roller 81 at the center of the right end thereof.

Original D cannot be directly retained by the platen sheet at cutout 96, but the original portion disposed at this position can be retained by feed roller 81. Hence, feed roller 81 can positively prevent original D from floating to cause an image to malfunction.

Platen sheet 95 is covered except at its lower surface by flat rectangular box-shaped cover body 97, which is attached at its rear end to apparatus body 1 through hinge number 74. Platen sheet 95 is fixed at its left end by clamping means directly to cover body 97, and is bonded at its upper and side surfaces to rockable frame 98. Frame 98 has a vertical surface which is rotatably attached to cover body 97.

In FIG. 5, reference numeral 99 (shown only at its front side) denotes the rotating fulcrum of frame 98. Fulcrum 99 is provided near the left end of rockable frame 98, and is located at the lateral center of the side surface of cover body 97. The right half of rockable frame 9 is rotatable about fulcrum 99 with respect to the left half of the platen sheet. A pair of compression springs 100 are arranged as energizing elements between the upper surface of rockable frame 98 at its free end (the upper surface of rockable frame 98 at its right end and the lower surface of cover body 97 to always energize downwardly its free end so that rockable frame 98 may be located in a horizontal state as designated by solid lines in FIG. 6. Thus, the entire lower surface of platen sheet 95 is ordinarily contacted with platen glass 3.

Rockable frame 9 is rotatably displaceable upwardly at a predetermined angle by gap forming means 105 (to be described later) against the energizing force of compression spring 100 at fulcrum 99 as a center. This forms a gap G having length 1 at an angle $\theta$ between the lower surface of the right half of platen sheet 96 and platen glass 3 by inclining the right half of platen sheet 95 as is illustrated by solid lines in FIG. 7 and two-dotted lines in FIG. 6.

Gap forming means 105 comprises, as is shown in FIGS. 5 and 6, driving mechanism 106, provided at the side of original feeding mechanism 73, and power transmitting mechanism 107, provided at the side of platen cover 70, for transmitting a force generated by driving mechanism 106 to movable frame 98.

Driving mechanism 106 is pivotally connected at its lower portion to the apparatus body by a shaft 108. Mechanism 106 is rotatably displaced upon rotation of an eccentric cam roller 111 which is contacted with a pressing tool (hereinafter referred to as a "pusher") 109. Pusher 109 is rotatable with shaft 108 as its rotating fulcrum by cam motor 110 as a drive source. Rotation of pusher 109 causes an upper end projection 109*a* of pusher 109 to project forward and retreat from platen cover 70. Pusher 109 is biased clockwise in FIG. 9 by an energizing element, not shown, to maintain contact with the peripheral surface of eccentric cam roller 111.

Power transmitting mechanism 107 is constructed as follows. Slider 115 has one end surface 115*a* positioned to oppose projection 109*a* of pusher 109. Slider 115 is able to reciprocate in a horizontal plane in response to movement of pusher 109. Slider 115 is connected at its other end to one end of horizontal shaft 117 through a linkage 116. Shaft 117 is mounted laterally in a space between the lower surface of cover body 97 and the upper surface of rockable frame 98. One end of each of a pair of levers 120 is attached to guide roller 119. Roller 119 is engaged in a pair of guide slots 118 (shown only in the front frame side) made of horizontally elongated holes formed in both side frames of rockable frame 98. The other ends of levers 120 are attached to opposite ends of horizontal shaft 117. Thus, the sliding operation of slider 115 is converted by the operation of linkage 116 to rotating operation of horizontal shaft 117, and rotatable levers 120 attached to shaft 117 are rotatably displaced at a predetermined angle, thereby rotating rockable frame 98.

In gap forming means 105, constructed as described above, as is shown by solid lines in FIG. 6, eccentric cam roller 111 is ordinarily stopped in the position where the minimum eccentric portion of eccentric cam roller 111 contacts pusher 109 so as not to push end surface 115*a* of slider 115. Therefore, a force for lifting the free end of rockable frame 115 is not generated, rockable frame 98 is pushed down by the force of compression spring 100 as to become horizontal, and the entire lower surface of platen sheet 95 contacts platen glass 3.

Cam motor 110 is driven according to a signal from a controller, not shown, in synchronism with supplying and exhausting original D. In this manner, when an original D is moved onto or off of platen glass 3 eccentric cam roller 111 is rotated so that its the maximum eccentric portion is stopped in contact with pusher 109 to rotatably displace pusher 109 as is shown by two-dotted lines in FIG. 6, and slider 115 is pushed by its projection 109*a* in a direction designated by an arrow. The sliding operation of slider 115 is converted to rotatable displacement of rotatable levers 120, as described above, thereby lifting the free end of rockable frame 98 against the energizing force of compression spring 100. Then, the right half of platen sheet 95 is separated from platen glass 3, thereby forming gap G having length 1 at angle $\theta$ between the lower surface of the right half portion of platen sheet 95 and platen glass 3 as is shown by solid lines in FIG. 7 and two-dotted lines in FIG. 6.

Reference numeral 125 denotes a cover which covers original feeding mechanism 73. Numeral 128 denotes a cover which covers part of gap forming means 105 projecting from the upper surface of cover body 97, i.e., parts of slider 115 and linkage 116.

Figure 8A:
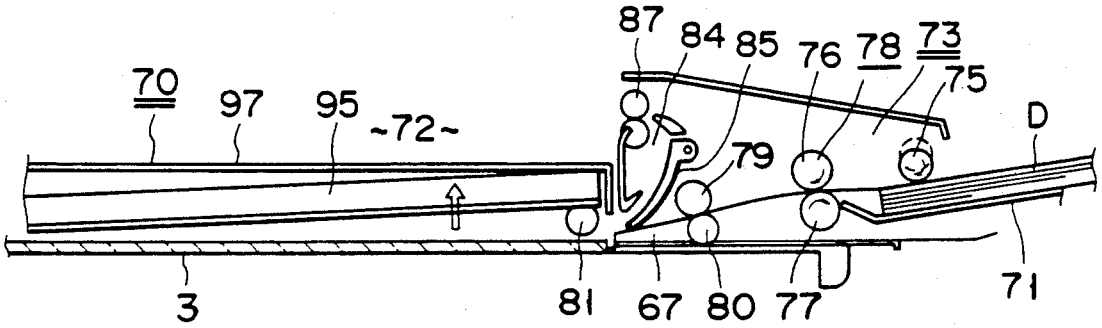
FIGS. 8A to 8H sequentially showing the operations of the automatic original feeder.
Figure 8B:
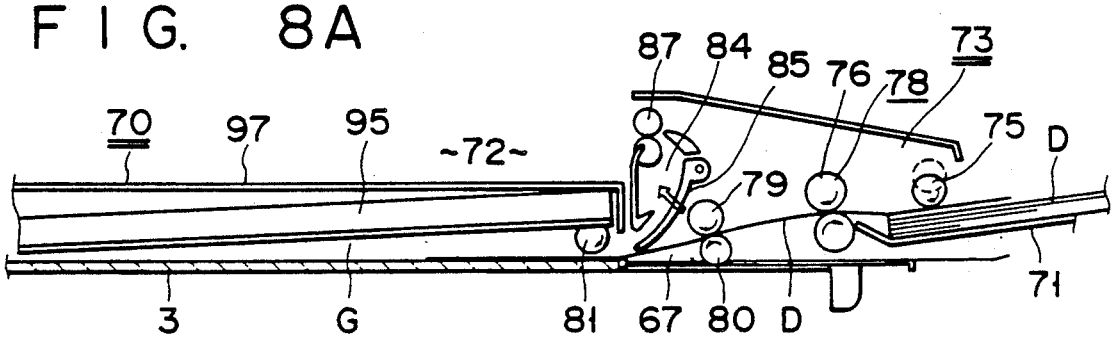

Referring to FIGS. 8A and 8B, the supplying and exhausting operations of original D to and from platen glass 3 by automatic original feeder (ADF) will now be described.

Figure 7:
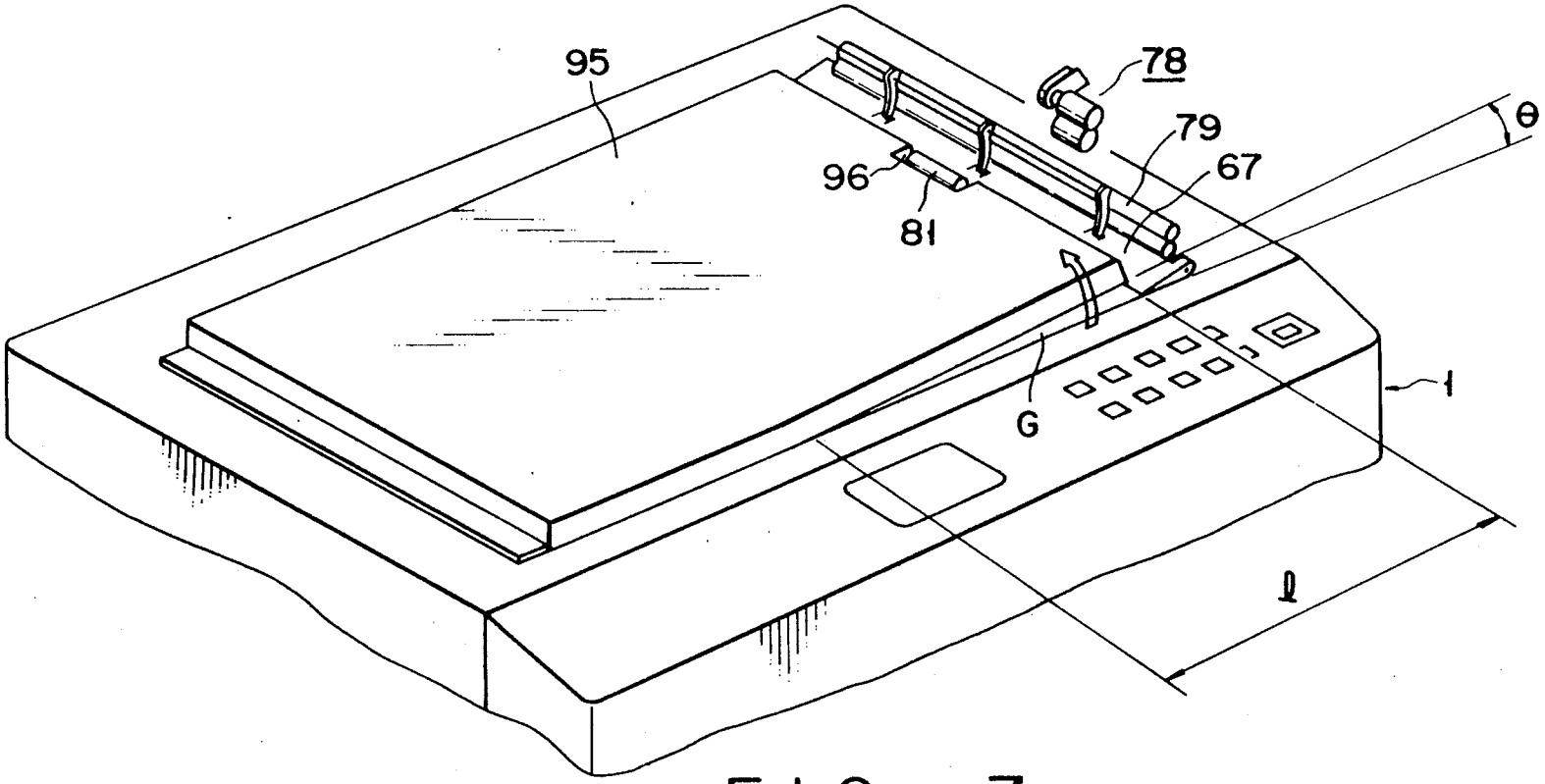
FIG. 7 is a view for explaining a gap forming state.

As is shown in FIG. 8A, after originals D are simultaneously set on original tray 71 with the original image surfaces down, copy key 7 (FIGS. 3A and 3B) is depressed. Then, pickup roller 75 is moved down, rotatably contacting with original D in the uppermost position. Then, pickup roller 75, supplying roller 76, and separating roller 77 of single sheet pickup means 78 are rotated to pick up original D in the uppermost position and move it leftwardly. Referring to FIGS. 5 and 6, driving mechanism 106 is operated at this time to push slider 115 by pusher 109, thereby forming gap G on the lower surface of the right half of platen sheet 95 as is shown in FIG. 7.

Original D contacts stop registering roller pair 79 which aligns the forward end of original D, and continuously conveys the original D leftwardly. Right scale 67 is raised in advance, as is shown in FIG. 8B, at this time, i.e., at a position slightly rotated clockwise. Gate 85 is pushed by original D to be retreated against its own weight. Then, original D is conveyed leftwardly on platen glass 3 by the rotation of feeding roller 81 in one direction. At this time, since platen glass 3 and white sheet 95*b* of platen sheet 95 are made of low frictional members, even if original D is longer than the length 1 of gap G, the forward end (left end) of sheet D is smoothly introduced by the strength of the body of sheet D between platen sheet 95 and platen glass 3 so as not to be bent.

Figure 8C:
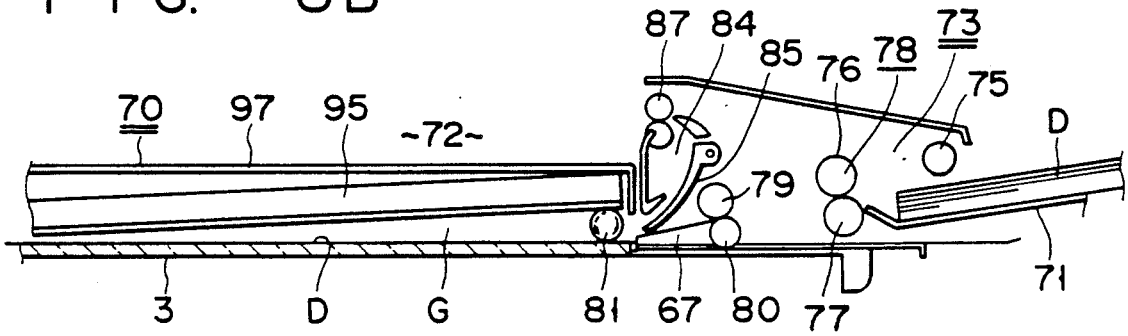

After the trailing edge (right end) of original D is conveyed to a position slightly separated leftwardly from the end of right scale 67, feeding roller 81 is reversely rotated, original D is thus conveyed rightwardly, the right end of original D contacts the left end surface of right scale 67 as is shown in FIG. 8C so that feeding roller 81 is stopped.

Figure 8D:
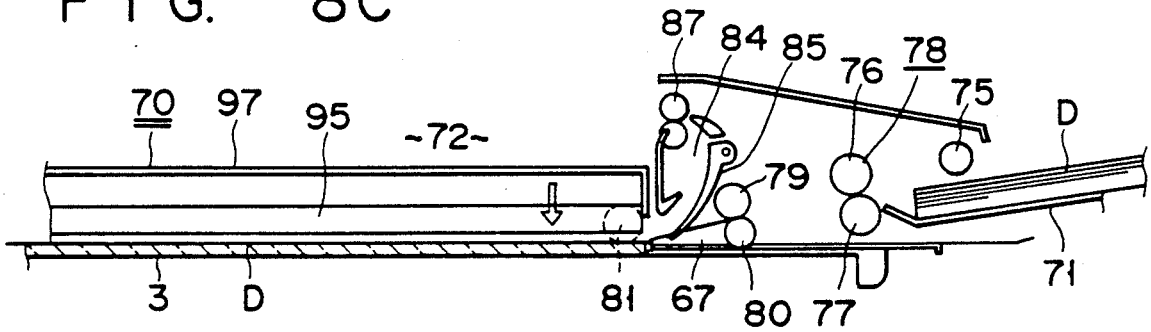

Then, as is shown in FIG. 8D, driving mechanism 106 of gap forming means 105 is again operated, the pressing operation of slider 115 by pusher 108 is released, rockable frame 98 to which the right half of platen sheet 95 is bonded is moved to its horizontal state by means of the recoiling force of compression Spring 100, and original D, positioned at right scale 67 as a reference, contacts platen glass 3.

Figure 8E:
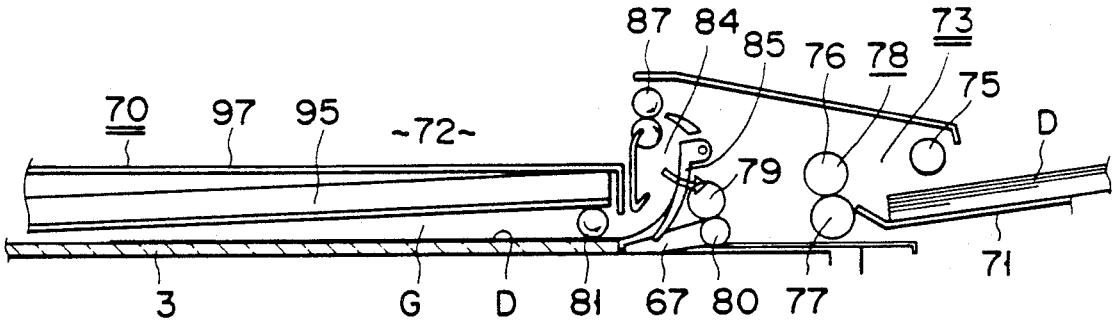
Figure 8F:
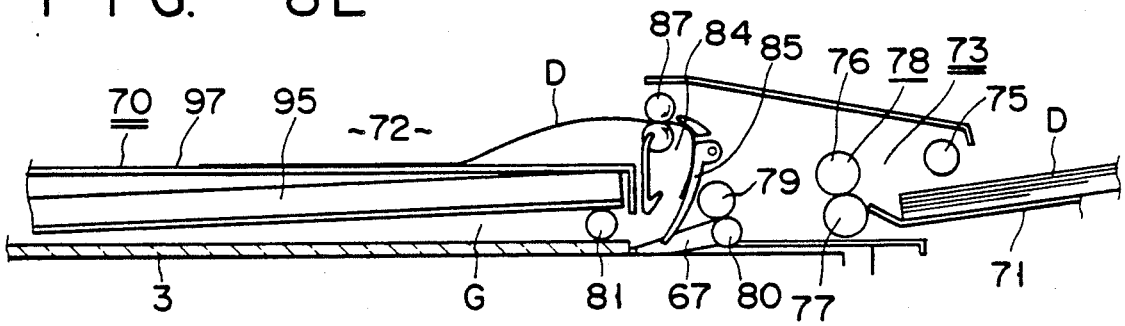
Figure 8G:
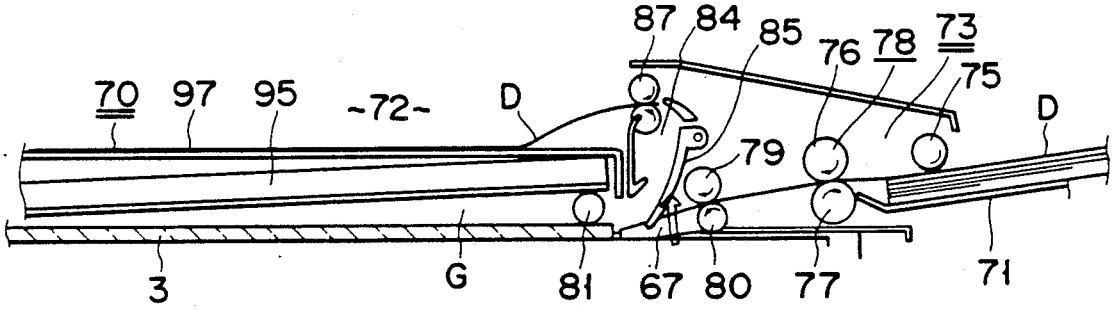

As mentioned above, when original D is completely set, original D is scanned by exposure device 23 (FIG. 2) in apparatus body 1. Upon completion of scanning one original D, right scale 67 is rotated counterclockwise as is shown in FIG. 8E, gate 85 is moved down by its own weight, and platen sheet 95 is rotated to form gap G. When feeding roller 81 is reversely rotated to convey original D rightwardly, original D is moved along gate 85, guided to original exhaust passage 84, and then exhausted to exhausted original container 72 through exhausting roller pair 87 as is shown in FIG. 8F. As is shown in FIG. 8G, right scale 67 is raised during this period until the trailing end of original D passes exhausting roller pair 87. The picking-up and supplying operations of subsequent originals D as shown in FIGS. 8A and 8B are then started, and the operations as is shown in FIGS. 8C to 8G are thereafter conducted.

Figure 8H:
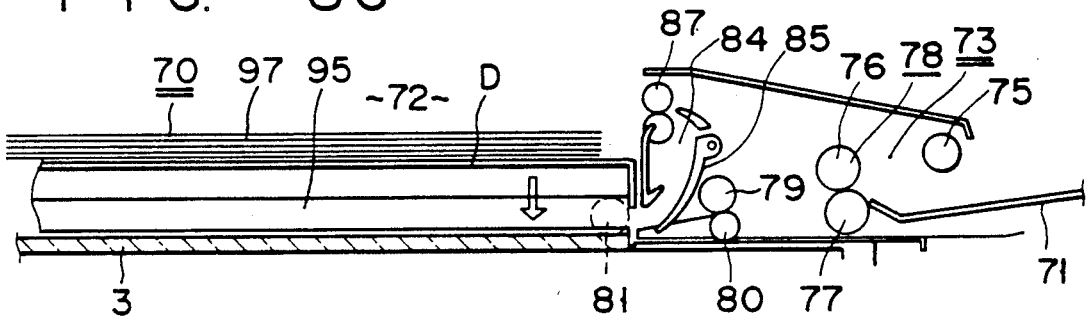

As mentioned above, when all originals on original tray 71 are copied and moved to exhausted original container 72, platen sheet 95 is moved down to become a normal platen cover 70 as is shown in FIG. 8H.

Figure 9:
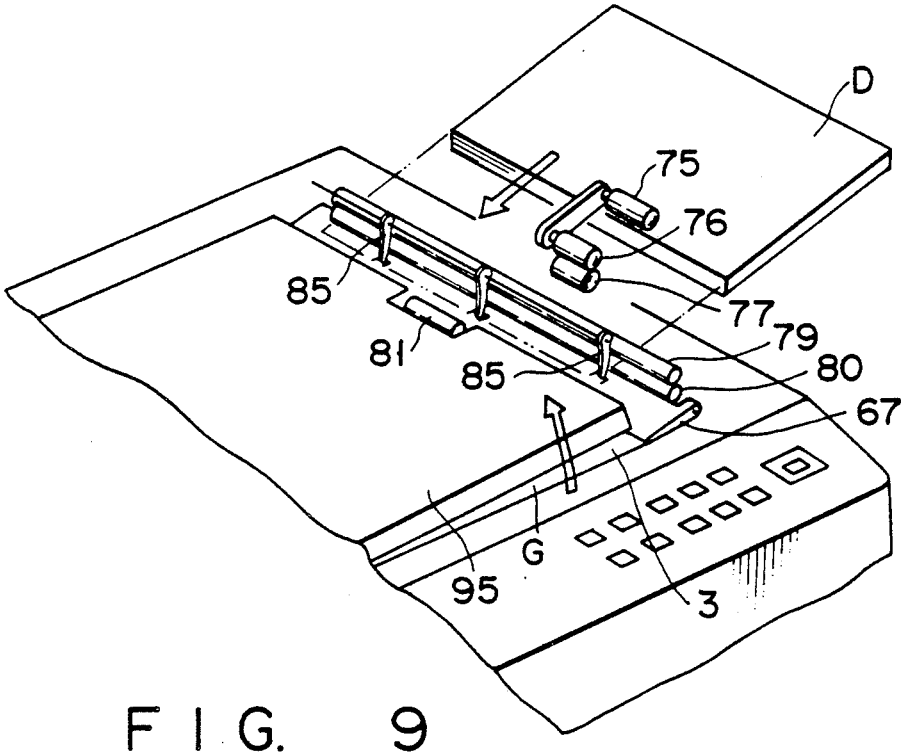
FIGS. 9 to 13 are views sequentially showing the operation states of the automatic original feeder.
Figure 10:
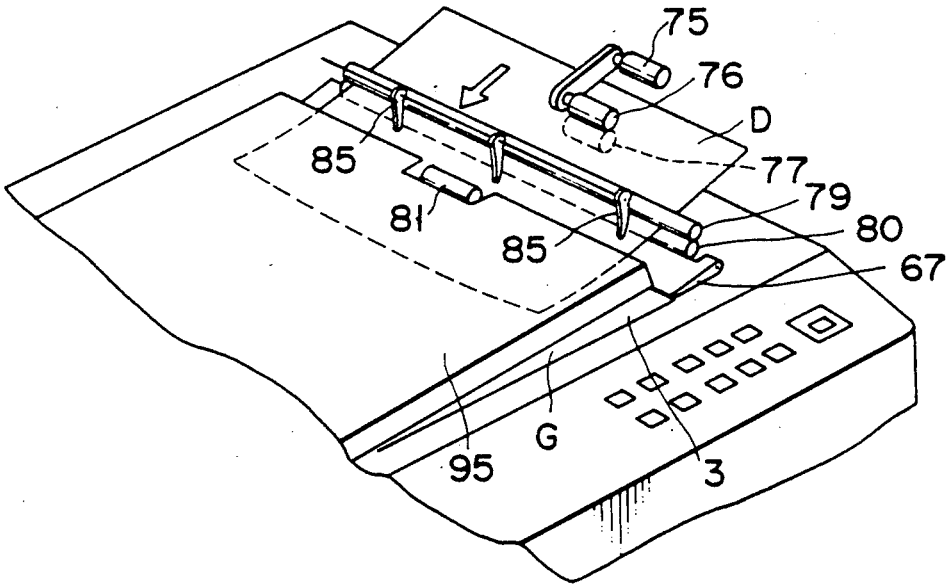
Figure 11:
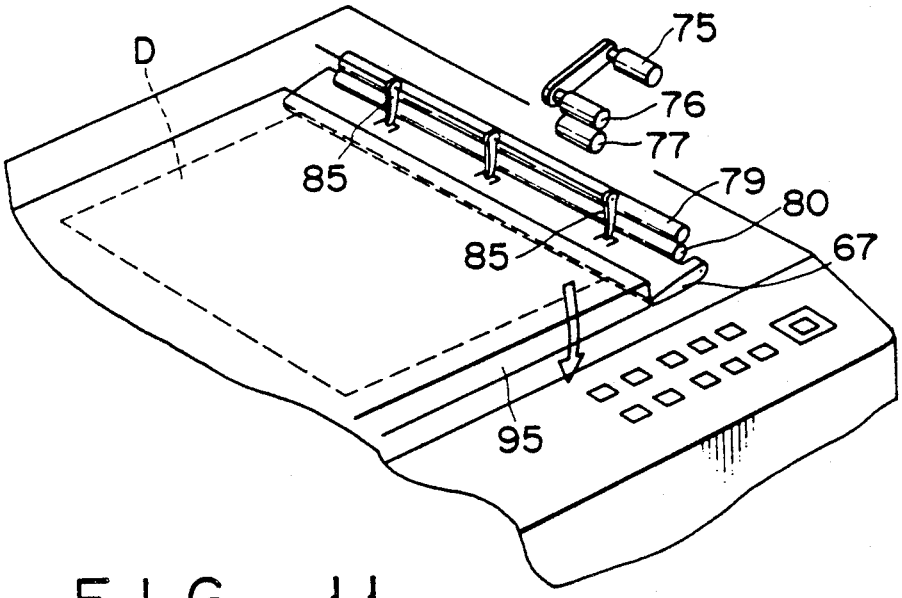
Figure 12:
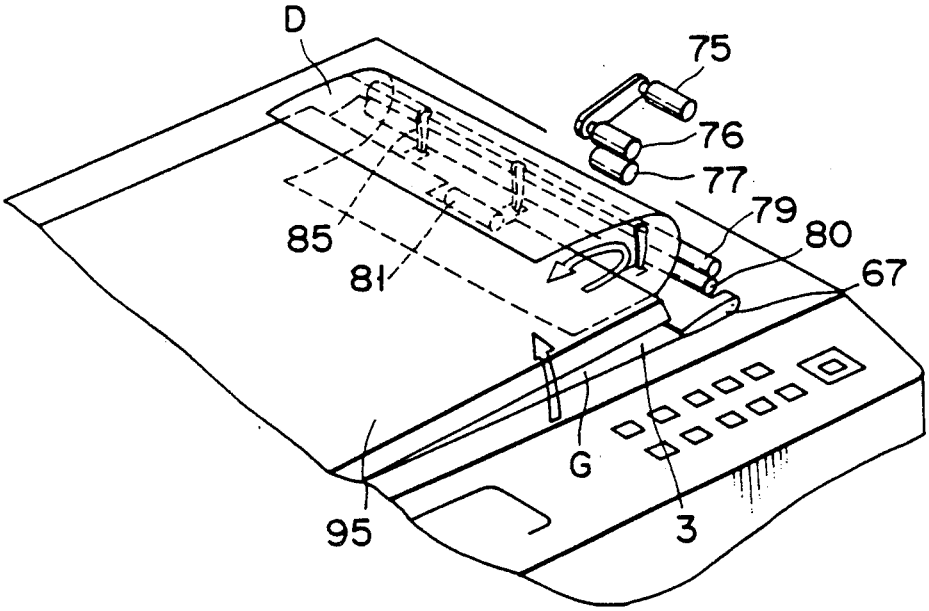
Figure 13:
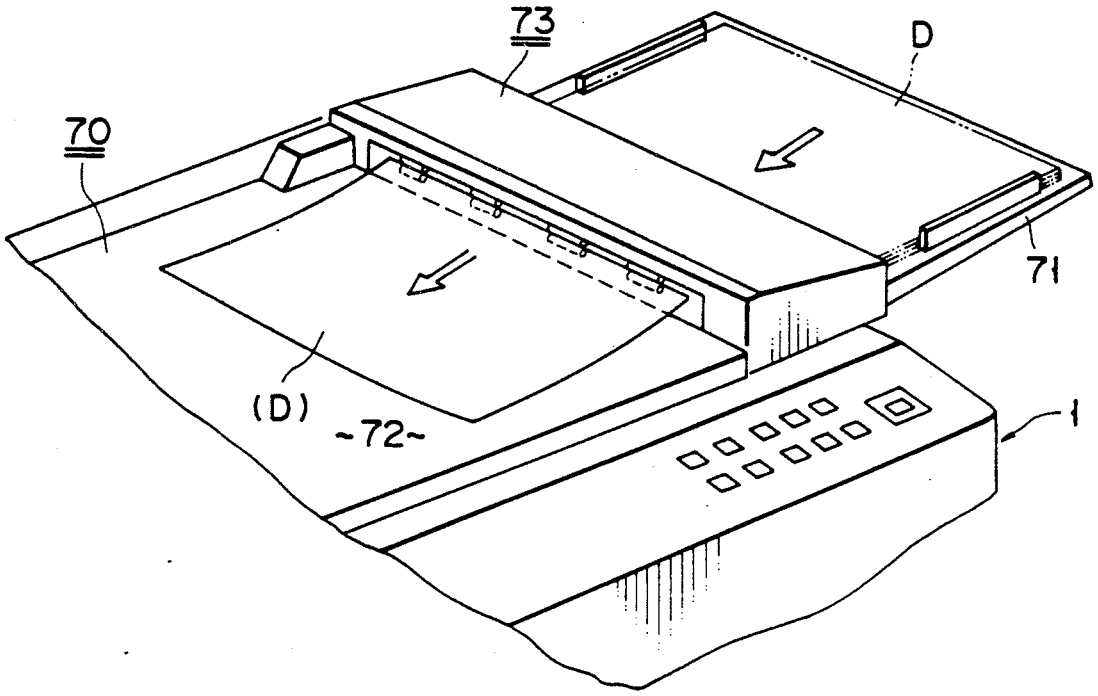

FIGS. 9 to 13 are views illustrating the operating states of automatic original feeder 4. FIGS. 9 and 10 sequentially show the states where platen sheet 95 is raised and original D is forcibly introduced to gap G, and FIG. 11 shows the state where the original is set o the platen glass with the right scale as a reference. FIG. 12 shows the state where the original is exhausted onto the platen glass, and FIG. 13 shows the state where the original is exhausted to the exhausted original container.

The copying operation of original D set on platen glass 3 by automatic original feeder (ADF) 4 will be described with reference to FIG. 2. When drum-shaped photosensitive unit 20 is rotated synchronously with the setting operation of original D by automatic original feeder 4 in the direction of the arrow (clockwise), photosensitive unit 20 is uniformly charged by charger 21. Then, first carriage 59, which orients exposure lamp 51 of exposure device 23 and first mirror 52, and second carriage 60, which orients second mirror 53 and third mirror 54, move to their left (to rightward of FIG. 2) along the lower surface of platen glass 3. When first carriage 59 arrives at a position slightly left from an intermediate portion, exposure lamp 51 is fired, original D set on platen glass 3 is scanned, and slit exposed on photosensitive unit 20. Thus, an electrostatic latent image corresponding to original D is formed on photosensitive unit 20.

The electrostatic latent image on photosensitive unit 20 is developed by upper developing unit 61 or lower developing unit 62 of developing device 24.

On the other hand, sheet P is automatically picked up from upper stage cassette 15 or lower stage cassette 16 synchronously with the forming operation of the developer image, or sheet P is received from manual sheet supply tray 30. Sheet P is fed to image transferring portion 31 through aligning roller pair 34, and the developer image formed in advance on photosensitive unit 20 is transferred by transferring device 25 to sheet P.

Then, sheet P is separated by separating device 26 from photosensitive unit 20, and fed to fixing device 35 through sheet conveying passage 33. In fixing device 35, a developer image is melted and fixed to sheet P. Then, sheet P is exhausted through exhausted sheet roller pair 32 into tray 17.

After the developer image is transferred t sheet P, photosensitive unit 20 rotates into a position opposing cleaning device 27 to be cleaned of any remaining developer (remaining toner). Next, photosensitive unit 20 rotates into opposition to electrostatic charge eliminator 28 which emits a light to remove electrostatic charges thus returning photosensitive unit 20 to its normal state capable of performing the next copying operation.

As described above, the copying operations are conducted until all originals D on the original tray are eliminated.

Original feeding mechanism 73 is provided at the exposure starting position of the optical system moving type exposure device 23, i.e., at the side of right scale 67 oppositely to the position near left scale 68. The original feeding mechanism 73 is set with right scale 67 opposite to the exposure starting position as a reference as is shown in FIG. 1. Therefore, the original supplying cycle when a number of small originals D of size A4 (which is half ($\frac{1}{2}$L) of the length (L+$\delta$) of platen glass 3) are automatically fed can be shortened to improve image forming efficiency. In subsequent copying operations, when small originals D of size A4 or the like are to be copied, a control signal is fed to exposure device 23 from an original size detecting means, not shown, and first carriage 59 of exposure device 23 is not returned to the left end. The first carriage 59 is held in a intermediate position so that original D is adjacent exposure lamp 51 and first mirror 52 as is shown by solid lines in FIG. 1. This positioning is repeated to eliminate wasteful time.

Figure 14:
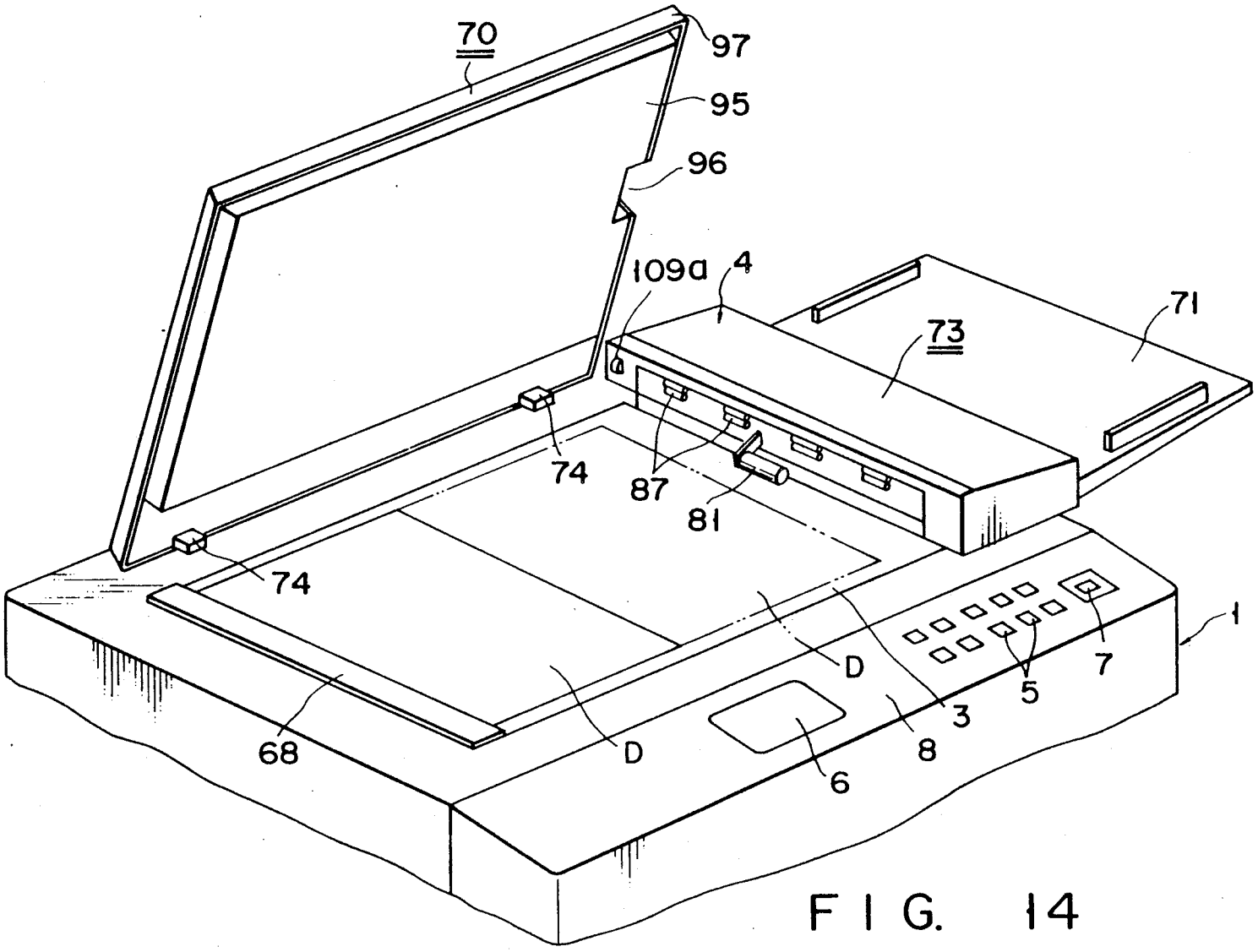
FIG. 14 is a perspective view showing the set state of the original when the original is artificially set.
Figure 15:
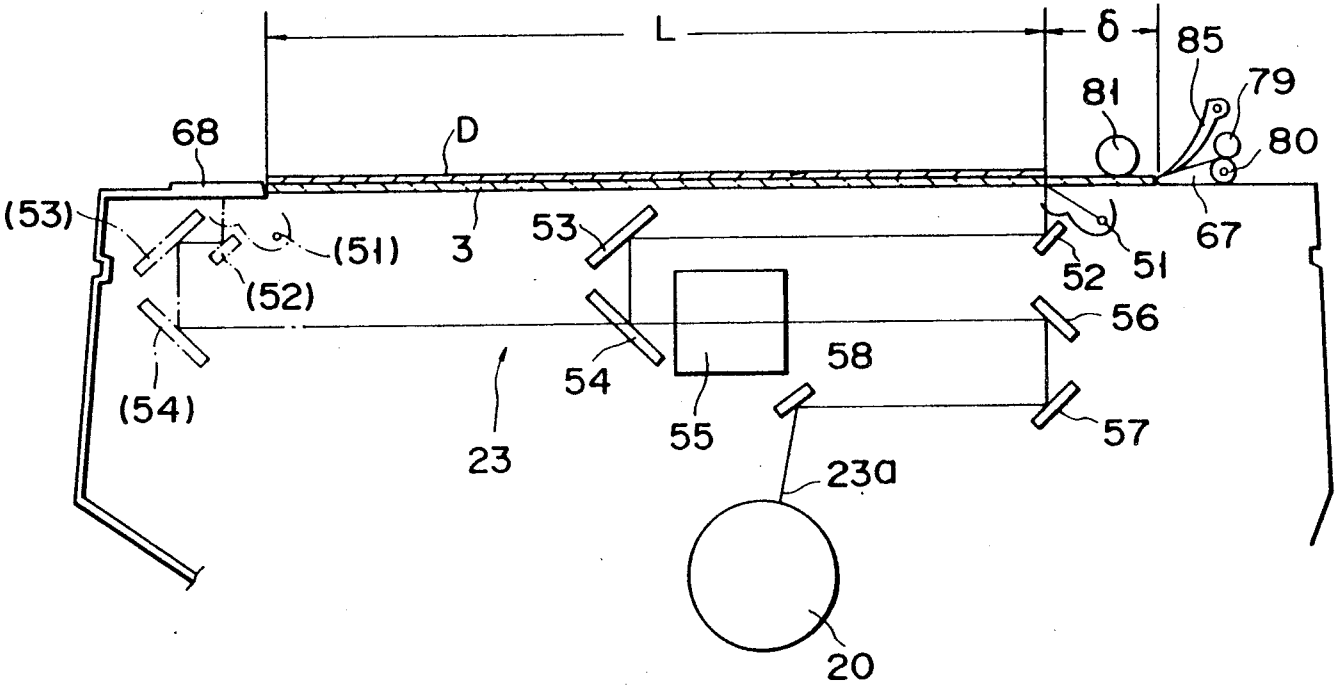
FIG. 15 is a view showing the state of the original in a manually set state.

Large originals D of A3 size or manually inserted originals D are set by opening platen cover 70 with the left scale 68 as a reference, as is shown in FIGS. 14 and 15. Since automatic original feeder 4 is not used at this time, when copy key 7 is depressed, the system is automatically switched to exposure scanning with left scale 68 as a reference. In other words, the stationary optical members of exposure device 23, such as lens 55, fourth mirror 56 and fifth mirror 57 are displaced to the left side from their position in the case of the use of the right scale reference, as shown in FIG. 1. Also, the movable optical members, such as exposure lamp 51, first mirror 52, second mirror 52 and third mirror 54 are moved to a position so as not to alter the optical path length.

Since normal copying is conducted with the left scale 68 as a reference by opening and closing the platen cover, an operator may not err in choosing the proper reference. As is shown in FIG. 15, even if an original D of maximum copying size L is set on the platen glass, since feeding roller 81 is located at a position outside the maximum copying length L, the original D does not contact feeding roller 81.

According to the present invention as described above, an automatic original feeder is provided comprising an original retaining cover having a platen sheet to be superposed o an original placing platen and an original feeding mechanism for feeding or exhausting the original between the platen sheet of the original retaining cover and the original placing platen. Therefore, a wide conveying belt and a belt driving mechanism are not required on the cover portion. This reduces the cost of the automatic original feeder, reduces the weight of the cover, and permits the cover to be easily opened and closed in the same manner as a normal original retaining cover. Further, since the prior art rotatable feed member in contact with the entire surface of the original placing platen is eliminated, high power and a large power source are not necessary. This reduces power consumption and power source size of the automatic original feeder and decreases its noise. Moreover, since the original feeding mechanism of the invention is provided at a side opposite to the exposure starting position of the optical system moving type exposure device, and since the original is set using a reference scale at the side opposite to the exposure starting position, when a number of small originals are automatically fed, the original supplying cycle can be shortened to improve image forming efficiency.

What is claimed is:

1. An original scanning apparatus, comprising:

a housing including an original placing platen having a scanned area;

original position aligning means provided at one side of the original placing platen, for aligning the original on the scanned area;

cover means covering the original on the scanned area of the original placing platen;

means for scanning the original which is aligned on the scanned area;

automatic sheet feeding means for feeding originals through said original position aligning means between the original placing platen and cover means, said automatic sheet feeding means including means for moving the original in one direction from the forward end thereof to a position between the original placing platen and cover means, and then moving the original in the opposite direction for aligning the trailing end of the original on said scanned area, against the original position aligning means;

the cover means including stationary means which is stationarily mounted on the housing during the scanning and feeding of the original, and a platen sheet attached to the stationary means with a movable portion positioned at least at the side of the position aligning means; and means for moving at least the movable portion of the platen sheet against the stationary means so that a clearance is formed between the movable portion and the original placing platen when the original is fed into the clearance by the automatic sheet feeding means, and moving the movable portion so that the original is pressed on the scanned area by the movable portion of the cover sheet when the original is aligned.

2. The original scanning apparatus according to claim 1, wherein said automatic sheet feeding means is provided at one end of the original placing platen, and said cover means comprises scanned original holding means formed on the upper surface of said cover means for holding scanned originals fed out of the original placing platen by said sheet exhausting means.

3. The original scanning apparatus according to claim 1, wherein said moving means includes a feed roller which is rotated in both directions to move the original in one or the opposite directions.

4. An original scanning apparatus comprising:

a housing having an original placing platen for placement of an original;

cover means for covering the original placing platen, the cover means including a stationary cover body and a cover sheet having a movable portion;

unscanned original holding means provided at one side of the original placing platen for holding the unscanned originals;

first and second original position control means provided on opposite sides of the original placing platen for aligning an original on either side of the original placing platen;

automatic sheet feeding means for feeding originals through said first original position control means into a clearance formed between the original placing platen and an open portion of the cover sheet when said original placing platen is covered by said cover means to position-control the original by one position control means;

scanning means provided movably along a moving path between said first position control means and said position control means for optically scanning an aligned original pressed on said original placing platen by the movable portion of the cover sheet to obtain information corresponding to the original;

image forming means for forming an image corresponding to the original based on said information; and sheet exhausting means for feeding a scanned original position-controlled by said first position control means from the original placing platen through said first original position control means out of the original placing platen.

5. An original scanning apparatus comprising:

a housing having an original placing platen for placement of an original;

cover means for covering the original placing platen;

unscanned original holding means provided at one side of the original placing platen for holding unscanned originals;

first and second original position control means provided on opposite sides of the original placing platen for position-controlling an original on either side of the original placing platen;

automatic sheet feeding means for feeding originals through said first original position control means between the original placing platen and said cover means when said original placing platen is covered by said cover means to position-control the original by one position control means;

scanning means provided movably along a moving path between said first position control means and said position control means for optically scanning an original placed on said original placing platen to obtain information corresponding to the original;

image forming means for forming an image corresponding to the original based on said information;

sheet exhausting means for feeding a scanned original position-controlled by said first position control means from the original placing platen through said first original position control means out of the original placing platen; and driving means for moving said scanning means from said first position control means to a predetermined position apart from the second position control means when said original is position-controlled by first position control means and then moving it from the predetermined position to said first position control means.

6. The original scanning apparatus according to claim 5, wherein said driving means comprises means for moving said scanning means from said second position control means to said first position control means when said original is position-controlled by said second position control means.

7. The original scanning apparatus according to claim 6, wherein said first and second position control means comprise scales for designating the size of the original.

8. An original scanning apparatus comprising:

a housing having an original placing platen for placing an original;

means for scanning an original on the original placing platen to obtain information corresponding to the original;

cover means for covering an original placed on the original placing platen, the cover means including a stationary cover body and cover sheet having a movable portion;

original position control means provided at one side of the original placing platen;

original feeding means provided separately from said cover means for feeding unscanned originals through said original position control means between the original placing platen and said cover means;

means for aligning the original by moving it backward and forward on the original placing plate;

means for feeding scanned originals from said original placing platen through said original position control means away from the original placing platen; and means for moving a portion of said cover means to separate said portion of said cover means at least at the side of the position control means from the original placing platen, to form a clearance through which an original is fed by said automatic sheet feeding means, and to press the original placing platen after the original is aligned and while the original is scanned by the scanning means.

9. The original scanning apparatus according to claim 8, wherein said original feeding means comprises a feeding roller provided on the original placing platen near said position control means for selectively feeding the originals in a direction toward the original placing platen and a direction away from the original placing platen, and guide means for guiding the original fed in a direction away from the original placing platen onto said cover means.

10. The original scanning apparatus according to claim 9, wherein said cover means comprises a platen sheet having one surface facing the original placing platen, and a cover body provided rotatably in said housing for supporting said platen sheet, and wherein the original is scanned by scanning means when the original is interposed between the platen sheet and the original placing platen.

11. The original scanning apparatus according to claim 10, wherein said platen sheet comprises a cutout on the end surface thereof, and said feeding roller is disposed in the cutout.

12. The original scanning apparatus according to claim 10, wherein said cover means comprises means for rotatably separating part of the platen sheet at the side of said position control means from the original placing platen when the original is fed by the feeding roller to the original placing platen and when the original is fed from the original placing platen away from the original placing platen.

13. An original scanning apparatus comprising:

a housing having an original placing platen for placing an original;

means for scanning an original on the original placing platen to obtain information corresponding to the original;

cover means for covering an original placed on the original placing platen, the cover means including a stationary cover body and a cover sheet having a movable portion;

original position control means provided at one side of the original placing platen; and an original feeding means provided separately from said cover means for feeding unscanned originals through said original position control means into a clearance between the original placing platen and the movable portion of said cover sheet of said cover means and feeding scanned originals from said original placing platen through said original position control means away from the original placing platen;

wherein said original feeding means comprises a feeding roller provided on the original placing platen near said position control means for selectively feeding the originals for alignment in a direction toward the original placing platen and a direction away from the original placing platen, and guide means for guiding the original fed in a direction away from the original placing platen onto said cover means; and wherein the movable portion presses the original placing platen for scanning after the originals is aligned.

14. An original scanning apparatus, comprising:

a housing having an original placing platen for placing an original;

means for scanning an original on the original placing platen;

means for covering an original on the original placing platen, the covering means including a frame, a cover means including a stationary cover body and a cover sheet;

the covering means having a movable portion movably supported by the frame;

the movable cover sheet and the original placing platen forming a clearance into which the original is fed;

means for aligning the original on the platen by moving the original backward and forward;

means for pressing the aligned original onto the original placing platen while the original is scanned by the scanning means;

means provided at one side of the original placing platen, for controlling the position of an original;

means for feeding a scanned original from the original placing platen through said original position control means; and means for moving the movable portion of the platen sheet to be apart from the original placing platen when the original is fed between the platen sheet and the original placing platen, the moving means including a drive source means provided separately from the cover means and means for transmitting a driving force to the movable portion of the platen sheet from the source means.

15. The original scanning apparatus according to claim 14, wherein said moving means moves the movable portion of the platen apart from the original placing platen when the original is exhausted from its position between the platen sheets.

16. An original scanning apparatus, comprising:

a housing having an original placing platen for placing an original;

means for scanning an original on the original placing platen;

means for covering an original on the original placing platen the covering means including a stationary cover body and a cover sheet having a movable portion;

means movably provided at one side of the original placing platen, which moves between a first position in which the original is aligned on the platen and a second position in which the original passes through the original position control means;

means for feeding the unscanned original in one direction from the forward end thereof between a clearance formed by the original placing plate and covering means, through the movable means, from the outside of the original placing platen, and then moving the original in the opposite direction for aligning the trailing end of the original on said original placing platen, against the movable means; and means for selectively moving the movable means into the first position when the unscanned original is fed in said one direction, and into the second position when the original is moved in said opposite direction.

17. An original scanning apparatus, comprising:

a housing having an original placing platen for placing an original;

means for scanning an original on the original placing platen;

means for covering an original on the original platen the cover means including a stationary cover body and cover sheet having a movable portion;

means for holding unscanned originals;

means provided at one side of the original placing platen for controlling the position of an original;

means including first feeding means provided separately from said covering means for feeding originals from the unscanned original holding means through said original position control means to a clearance between the original placing platen and said covering means, and second feeding means provided on the original placing platen for feeding the original between the platen and the covering means in one direction and in the opposite direction toward the original position control means to align the original;

wherein the movable portion of the covering means presses the aligned original against the original placing platen while the original is scanned by the scanning means; and means positioned between the position control means and first feeding means for guiding a scanned original fed from the original placing platen through said original position control means to the unscanned original holding means by the second feeding means.

* * * * *